US009398801B2

(12) United States Patent
Yoshida et al.

(10) Patent No.: US 9,398,801 B2
(45) Date of Patent: Jul. 26, 2016

(54) COSMETIC CONTAINER

(71) Applicant: YOSHIDA INDUSTRIES CO., LTD., Tokyo (JP)

(72) Inventors: Yuzo Yoshida, Tokyo (JP); Michiaki Kumagai, Tokyo (JP)

(73) Assignee: Yoshida Industries Co., Ltd., Tokyo (JP)

( * ) Notice: Subject to any disclaimer, the term of this patent is extended or adjusted under 35 U.S.C. 154(b) by 0 days.

(21) Appl. No.: 14/367,446

(22) PCT Filed: Dec. 10, 2012

(86) PCT No.: PCT/JP2012/081913

§ 371 (c)(1),
(2) Date: Jun. 20, 2014

(87) PCT Pub. No.: WO2013/094455

PCT Pub. Date: Jun. 27, 2013

(65) Prior Publication Data

US 2015/0021347 A1 Jan. 22, 2015

(30) Foreign Application Priority Data

Dec. 21, 2011 (JP) ..... 2011-280197

(51) Int. Cl.

| | |
|---|---|
| ***B65D 43/16*** | (2006.01) |
| ***A45C 13/00*** | (2006.01) |
| ***E05D 11/10*** | (2006.01) |
| ***B65D 43/22*** | (2006.01) |
| ***B65D 43/24*** | (2006.01) |
| ***B65D 43/14*** | (2006.01) |
| ***B65D 51/04*** | (2006.01) |
| ***A45D 40/22*** | (2006.01) |

(52) U.S. Cl.

CPC ..... *A45D 40/221* (2013.01); *A45D 2040/225* (2013.01); *A45D 2040/226* (2013.01); *A45D 2040/227* (2013.01)

(58) Field of Classification Search

CPC ..... B65D 43/164; B65D 2251/1033; B65D 2251/1008; A45D 2040/225; A45D 2040/226; A45D 2040/227; A45D 2040/228; A45D 40/221; A45C 13/007; E05D 11/1028; E05D 11/1078; E05D 2011/1035

USPC ..... 220/830, 831, 838

See application file for complete search history.

(56) References Cited

U.S. PATENT DOCUMENTS

| | | | | |
|---|---|---|---|---|
| 6,633,643 | B1 | 10/2003 | Ona | |
| 6,913,143 | B2 * | 7/2005 | Yang | 206/371 |

FOREIGN PATENT DOCUMENTS

| | | | |
|---|---|---|---|
| JP | 2001-185868 | A | 7/2001 |
| JP | 2004-201955 | A | 7/2004 |
| JP | 2005-137536 | A | 6/2005 |
| JP | 2005-348886 | A | 12/2005 |
| JP | 2006-081576 | A | 3/2006 |
| JP | 2007-016954 | A | 1/2007 |
| WO | WO-2011/099504 | A1 | 8/2011 |

OTHER PUBLICATIONS

International Search Report for PCT/JP2012/081913, ISA/JP, mailed Jan. 22, 2013.

International Preliminary Report on Patentability, Application No. PCT/JP2012/081913, Jul. 3, 2014.

* cited by examiner

*Primary Examiner* — Fenn Mathew

*Assistant Examiner* — Andrew T Kirsch

(74) *Attorney, Agent, or Firm* — Harness, Dickey & Pierce, P.L.C.

(57) ABSTRACT

A cosmetic container which is capable of stabilizing an action of a hinge portion is provided with a single pivot shaft member, and improving opening and closing functions of a lid body. Included are: a container main body configured to contain a cosmetic; a lid body turnably provided to the container main body and capable of opening and closing the container main body; and a first pivot support member and a second pivot support mechanism disposed on a pivot axis about which the lid body turns, and causing the container main body to turnably support the lid body. The first pivot support member includes: a compression coil spring located between the container main body and the lid body; and a lock member and a pivot member. The second pivot support mechanism includes fan-shaped recessed and projecting portions and a shaft portion of the second pivot support member.

3 Claims, 6 Drawing Sheets

COSMETIC CONTAINER

CROSS-REFERENCE TO RELATED APPLICATIONS

This application is a 371 U.S. National Stage of International Application No. PCT/JP2012/081913, filed Dec. 10, 2012. This application claims priority to Japanese Patent Application No. 2011-280197, filed Dec. 21, 2011. The disclosures of the above applications are incorporated herein by reference.

TECHNICAL FIELD

The present invention relates to a cosmetic container which is capable of stabilizing an action of a hinge portion provided with a single pivot shaft member having biasing means, and improving opening and closing functions of a lid body.

BACKGROUND ART

Among cosmetic containers each provided with a container main body designed to contain a cosmetic and with a lid body turnably provided to the container main body, there are cosmetic containers including a so-called free-stop mechanism which is designed to maintain the lid body in an opened state. A hinge portion for realizing such a free-stop mechanism for the lid body includes, for example, a bearing member non-turnably fitted into the lid body, and a pivot shaft member non-turnably fixed to the container main body. Here, two hinge portions are provided between the container main body and the lid body in such a way as to sandwich one member out of the container main body and the lid body.

Compact containers of PTL 1 and PTL 2 have been known as compact containers of this type. The "compact container" of PTL 1 is formed by turnably coupling a lid body to a container main body by using a hinge portion. The hinge portion includes: a bearing member fixed to the lid body; a pivot member fixed to the container main body and provided with an engagement recessed portion formed from an inclined surface; an engagement member provided with an engagement projecting portion to be engaged with the engagement recessed portion; and a pivot shaft member provided with a biasing member to bias the engagement member toward the pivot member. In addition, a magnet and a magnetic body are disposed at predetermined positions in the lid body and the container main body, respectively. In the state where the lid body closes the container main body, the hinge portion biases the lid body in a direction to close the container main body, and holds the lid body and the container main body in the closed state by attraction between the magnet and the magnetic body.

The "compact container" of PTL 2 is formed by turnably coupling a lid body to a container main body by use of a hinge portion. A hinge includes: a first pivot portion having a spring pin provided in line with a pivot axis; and a second pivot portion having a bearing member fixed to the lid body, a pivot member fixed to the container main body and provided with an engagement recessed portion formed from an inclined surface, an engagement member provided with an engagement projecting portion to be engaged with the engagement recessed portion, and a pivot shaft member provided with a biasing member to bias the engagement member. The above-described pivot shaft members for realizing the free-stop mechanism are also used in mobile telephones and the like, and are therefore highly versatile. Hence, some of the pivot shaft members are unitized.

CITATION LIST

Patent Literature

[PTL 1] Japanese Patent Application Publication No. 2005-348886

[PTL 2] Japanese Patent Application Publication No. 2006-81576

SUMMARY OF INVENTION

Technical Problems

Unlike electronic devices such as mobile telephones, it is necessary to reduce costs of cosmetic containers because unit prices of the cosmetic containers are considerably lower than unit prices of the electronic devices. For this reason, in order to realize the free-stop mechanism at low costs, an expensive unitized pivot shaft member such as one described above in the related art is used only on one side. In the meantime, on the other side, either a projecting portion or a recessed portion is provided on the container main body side while the remaining one of the projecting portion and the recessed portion is provided on the lid body such that the recessed portion and the projecting portion are turnably engaged with each other, and/or a spring pin is provided thereto.

However, the use of the single unitized pivot shaft member leads to a reduction in the biasing force by the biasing member or a reduction in a force to hold the opened lid body. Accordingly, there are problems that the opened lid body becomes unstable, and that it is not possible to move a cosmetic container while keeping its proper position due to an opening action of the lid body occurring when the cosmetic container with its lid body in the closed state during a manufacturing process is conveyed by holding the lid body by means of suctioning or the like.

The present invention has been conceived of in view of the aforementioned problems of the related art. An object of the present invention is to provide a cosmetic container capable of stabilizing an action of a hinge portion provided with a single pivot shaft member having biasing means, and improving opening and closing functions of a lid body.

Solution to Problems

A cosmetic container is characterized as follows. The cosmetic container includes: a container main body configured to contain a cosmetic; a lid body turnably provided to the container main body and capable of opening and closing the container main body; and a pair of a first pivot support member and a second pivot support mechanism disposed on a pivot axis about which the lid body turns, and causing the container main body to turnably support the lid body 3. The first pivot support member includes: a resilience generating member located between the container main body and the lid body and configured to generate resilience when compressed in a direction along the pivot axis; and first compressing and releasing means for compressing the resilience generating member in the direction along the pivot axis and for releasing the compression by turning of the lid body. The second pivot support mechanism includes second compressing and releasing means for compressing the resilience generating member in the direction along the pivot axis and for releasing the compression by turning of the lid body.

The cosmetic container is characterized as follows. The second compressing and releasing means includes: a projecting member including a projecting portion projecting in the direction along the pivot axis; and a recessed member including a recessed portion enabling the projecting portion to be inserted. The projecting member and the recessed member are arranged in such a manner that the projecting portion and the recessed portion are opposed to each other in the direction along the pivot axis, and are configured to compress the resilience generating member by causing the projecting portion to come out of the recessed portion by the turning of the lid body and to release the compression of the resilience generating member by insertion of the projecting portion into the recessed portion. One of the projecting member and the recessed member is provided to one of the container main body and the lid body, while the other one of the projecting member and the recessed member is provided to the other one of the container main body and the lid body. At least any one of the projecting member and the recessed member is integrated with one of the container main body and the lid body.

The cosmetic container is characterized in that at least any one of the projecting member and the recessed member is formed as a separate member from one of the container main body and the lid body instead of being integrated with the one of the container main body and the lid body.

Advantageous Effects of Invention

A cosmetic container of the present invention can stabilize an action of a hinge portion provided with a single pivot shaft member having biasing means, and improve opening and closing functions of a lid body.

DESCRIPTION OF EMBODIMENTS

Figure 1:
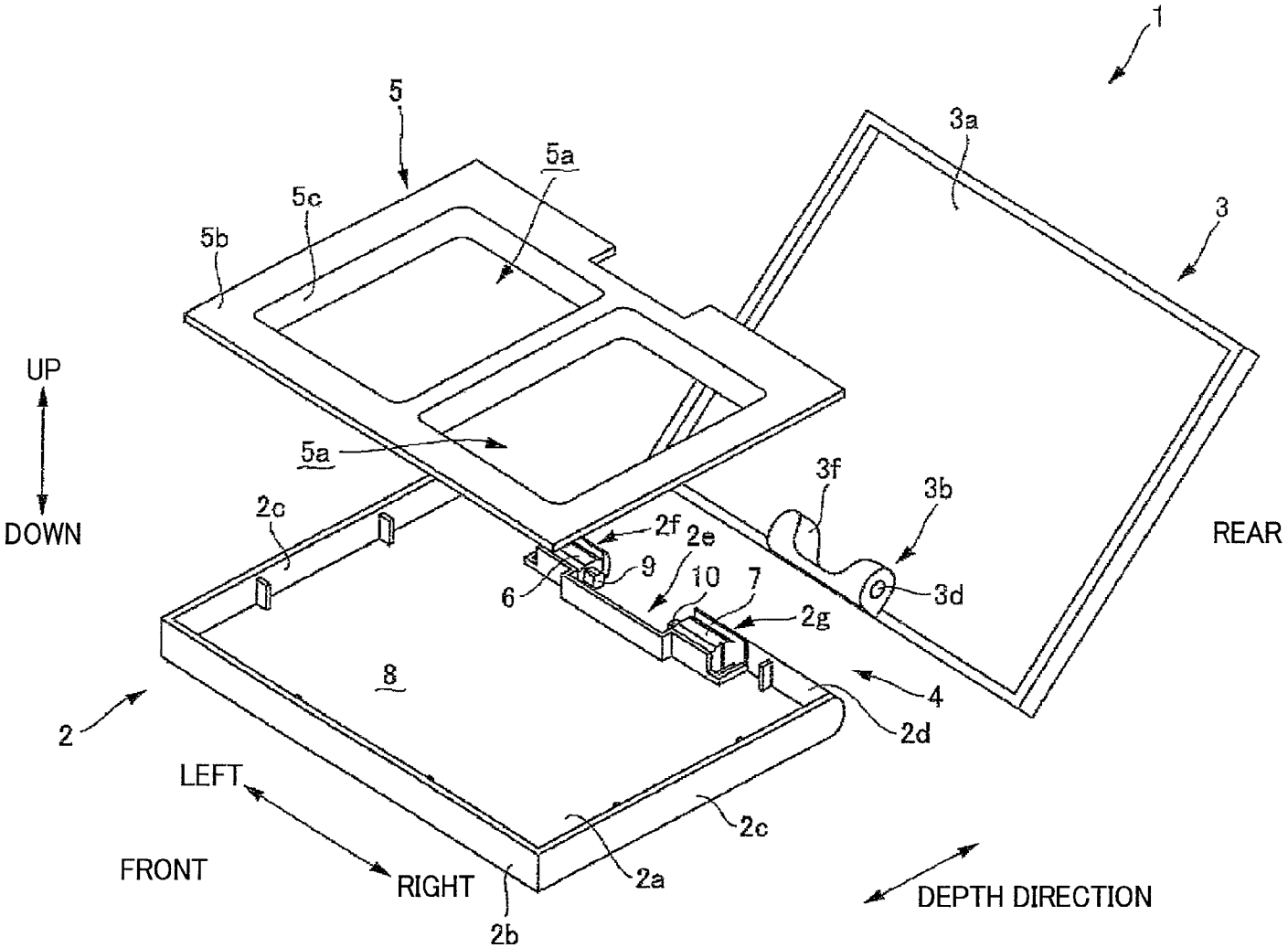
FIG. 1 is an exploded perspective view showing a preferred embodiment of a cosmetic container according to the present invention.
Figure 2:
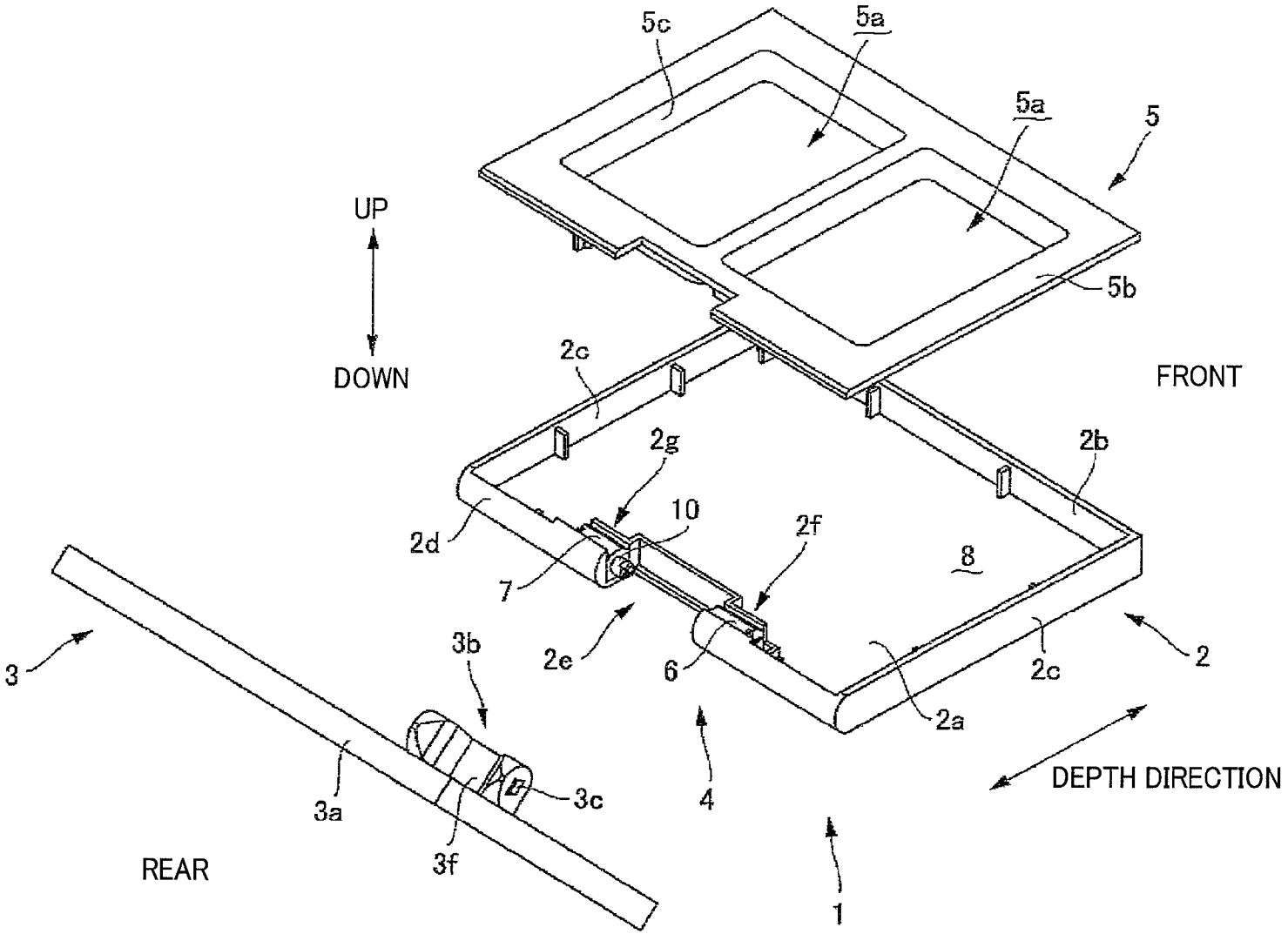
FIG. 2 is an exploded perspective view of the cosmetic container shown in FIG. 1, which is viewed from a hinge side.

A preferred embodiment of a cosmetic container according to the present invention will be described below in detail with reference to the accompanying drawings. FIG. 1 is an exploded perspective view of the cosmetic container of the embodiment. FIG. 2 is an exploded perspective view of the cosmetic container shown in FIG. 1, which is viewed from a hinge side. The cosmetic container of the embodiment shown in FIG. 1 and FIG. 2 is a so-called compact container 1, in which a lid body 3 is turnably provided to a container main body 2 by using a hinge 4. Here, the container main body 2 contains a cosmetic.

The compact container 1 of the embodiment includes: a frame body 5 provided with dish holding portions 5*a* each of which can contain a cosmetic dish (not shown) that contains the cosmetic; a container main body 2 designed to contain the cosmetic dishes as the frame body 5 is fitted into the container main body 2; a lid body 3 turnably provided to the container main body 2 and capable of opening and closing the container main body 2; and a pair of a first pivot support member 6 and a second pivot support mechanism 7 collectively forming the hinge 4 for turning the lid body 3, being disposed with an interval in between on a pivot axis about which the lid body 3 turns, and causing the container main body 2 to turnably support the lid body 3.

The following description will be made on the basis of a state where the compact container 1 is in use. Specifically, an opening end side of the lid body 3 to be opened and closed by the hinge 4 will be defined as a front side and the hinge 4 side will be defined as a rear side. Meanwhile, a direction from the front side to the rear side will be referred to as a front-rear direction or a depth direction. When the compact container 1 is viewed from the front side, a direction from a right side to a left side will be referred to as a horizontal direction, and a direction from an upper side to a lower side will be referred to as a vertical direction. Here, each of components forming the compact container 1 will be described below while specifying its direction based on the depth direction, the horizontal direction, and the vertical direction in the above-described state in use even if such a component is described on a stand-alone basis.

The container main body 2 includes: a front wall portion 2*b*; a rear wall portion 2*d* opposed to the front wall portion 2*b* in the depth direction; and a right and left pair of side wall portions 2*c* which join the front wall portion 2*b* and the rear wall portion 2*d* together. These wall portions rise up from outer peripheral edges of a bottom portion 2*a*. Inside the front wall portion 2*b*, the rear wall portion 2*d*, and the side wall portions 2*c*, a tray-like recessed portion 8 having a planar profile of a substantially rectangular shape is defined by the wall portions 2*b*, 2*c*, and 2*d*.

A hinge recessed portion 2*e*, which is designed to contain a hinge projecting portion 3*b* provided to the lid body 3, is provided substantially in the center in the horizontal direction of the rear wall portion 2*d* of the container main body 2. In the horizontal direction of the rear wall portion 2*d*, support member fitting portions 2*f* and 2*g* into which the first pivot support member 6 and the second pivot support mechanism 7 are fitted from above are respectively provided on two sides of the hinge recessed portion 2*e*. In the compact container 1 of the embodiment, the first pivot support member 6 is fitted into the support member fitting portion 2*f* on the left side while the second pivot support mechanism 7 is fitted into the support member fitting portion 2*g* on the right side.

The lid body 3 includes: a substantially plate-shaped lid main body 3*a* designed to cover an upper part of the container main body 2 and provided with an edge portion which is hung a little from substantially the entire periphery; and the hinge projecting portion 3*b* provided substantially in the center in the horizontal direction at a rear end of the lid main body 3*a* in such a way as to project downward. In the lid body 3, the hinge projecting portion 3*b* is turnably joined to the container main body 2 and is made capable of opening and closing the container main body 2.

An outer peripheral surface of the hinge projecting portion 3*b* is formed into an arc shape centered at a pivoting axis of the hinge 4. Two end portions of the hinge projecting portion 3*b* are formed into substantially the same shape as that of regions of the container main body 2 opposed thereto when the hinge projecting portion 3*b* is attached to the container main body 2. A curved portion 3*f* is formed at a central portion of the hinge projecting portion 3*b* in such a manner as to be recessed in the depth direction. For this reason, the hinge projecting portion 3*b* is formed to have slightly lower rigidity in terms of the horizontal direction and is thereby configured to be elastically deformed a little when the lid body 3 is attached to the container main body 2.

Moreover, of the hinge projecting portion 3*b*, a fitting hole 3*c*, into which a shaft portion 9 of the first pivot support member 6 having a square cross section is fitted, is provided in a surface opposed to the first pivot support member 6, and an insertion hole 3*d*, into which a shaft portion 10 of the second pivot support mechanism 7 having a circular cross section is inserted, is provided in a surface opposed to the second pivot support mechanism 7. A cross-sectional shape of the fitting hole 3*c* is formed into a square shape so that the shaft portion 9 of the first pivot support member 6 can be fitted thereinto and a force acting on the lid body 3 can be reliably transmitted to the first pivot support member 6. However, the cross-sectional shape is not limited only to the foregoing.

Figure 3:
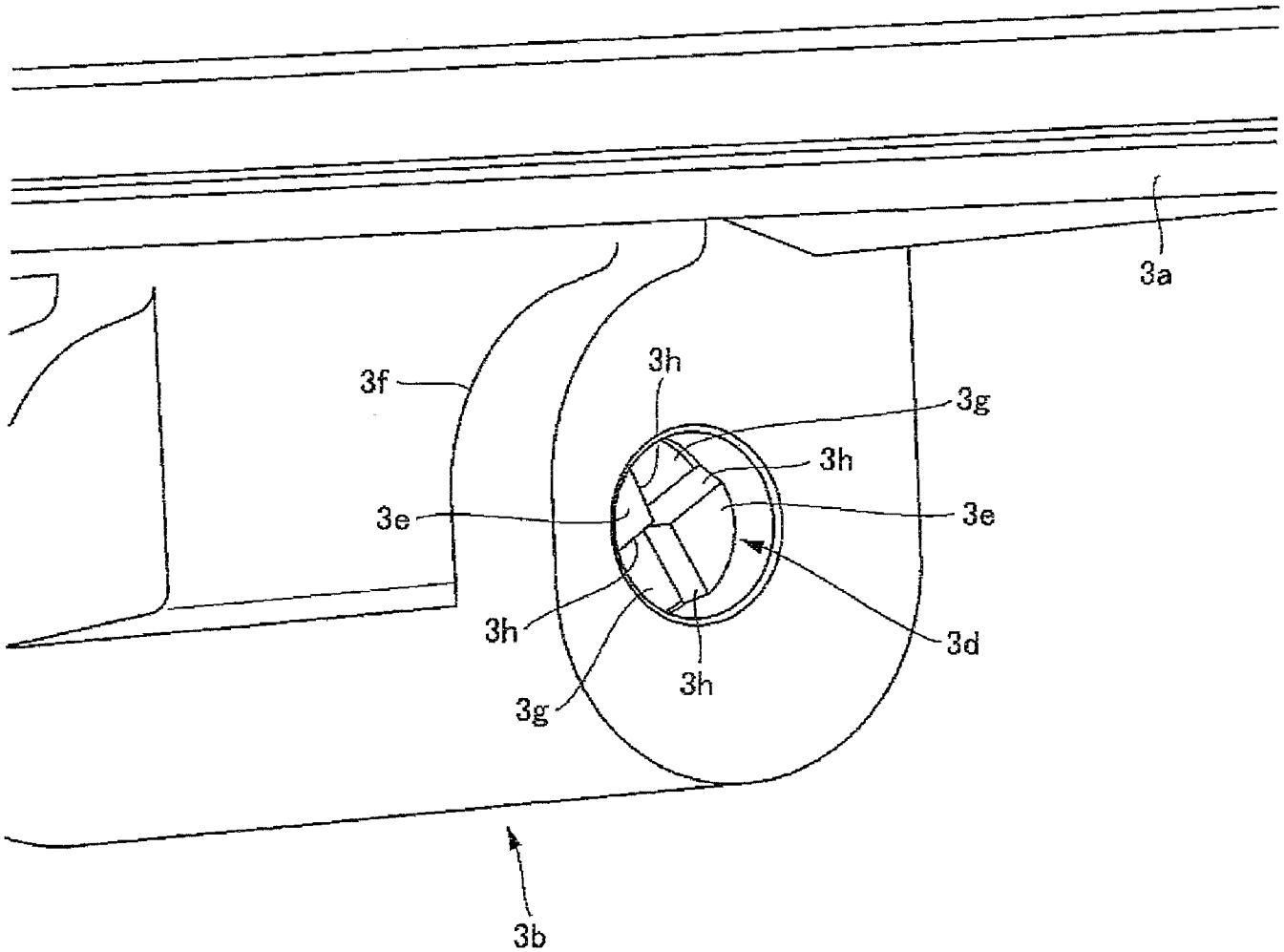
FIG. 3 is a perspective view showing an insertion hole provided on a lid body side of the cosmetic container of FIG. 1, into which a shaft portion of a second pivot support mechanism is inserted.

FIG. 3 is a perspective view showing the insertion hole 3*d* provided on the lid body 3 side, into which the shaft portion 10 of the second pivot support mechanism 7 is inserted. As shown in FIG. 3, fan-shaped projecting portions 3*e* and fan-shaped recessed portions 3*g* each formed into a fan shape and designed to be engaged with the second pivot support mechanism 7 are formed on a bottom surface of the insertion hole 3*d*. The fan-shaped projecting portions 3*e* and the fan-shaped recessed portions 3*g* will be described later.

The frame body 5 is fitted into a recessed portion 8 of the container main body 2. The frame body 5 includes the two dish holding portions 5*a* arranged on the right and left and each formed substantially into a rectangular shape. In the frame body 5, peripheral wall portions 5*c*, which form hole portions serving as the dish holding portions 5*a* in the inside of the recessed portion 8 of the container main body 2, are hung from a top plate portion 5*b* forming a surface flush with upper edges of the front wall portion 2*b*, the rear wall portion 2*d*, and the right and left pair of side wall portions 2*c*. When the frame body 5 is fitted into the container main body 2, the first pivot support member 6 and the second pivot support mechanism 7 fitted in the support member fitting portions 2*f* and 2*g* are covered by the frame body 5, and only the shaft portions 9 and 10 projecting to the hinge recessed portion 2*e* are exposed.

Figure 4:
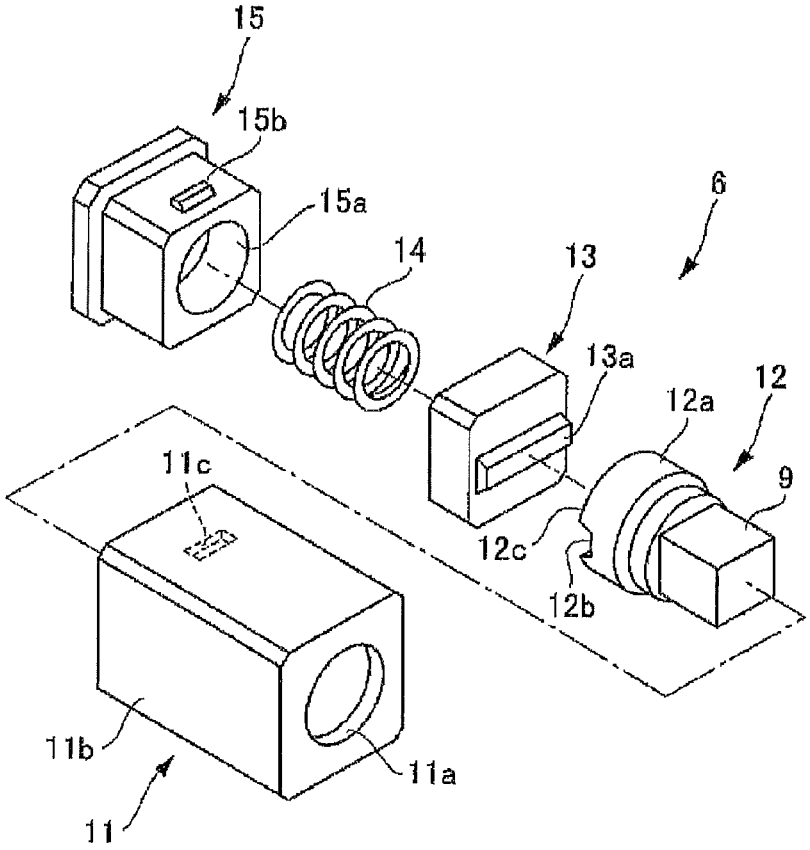
FIG. 4 is an exploded perspective view showing a configuration of a first pivot support member of the cosmetic container of FIG. 1.

FIG. 4 is an exploded perspective view showing a configuration of the first pivot support member 6. The first pivot support member 6 is formed by integrally unitizing the following five members, enumerated from the side near the hinge projecting portion 3*b* in a state where the compact container 1 is assembled: a cover member 11; a pivot member 12 turnably supported by the cover member 11; a lock member 13 disposed slidably along an inner side surface of the cover member 11 and designed to be engaged with the pivot member 12 in response to a turning angle of the pivot member 12; a compression coil spring 14 serving as a resilience generating member configured to bias the lock member 13 toward the pivot member 12; and a cover bottom member 15 coming into contact with the compression coil spring 14 and being locked to the cover member 11.

The cover member 11 is the member configured to form an exterior portion of the first pivot support member 6 and its external shape and internal shape are each formed into a rectangular parallelepiped. Moreover, a circular hole 11*a* is formed in an end portion on the hinge projecting portion 3*b* side of the cover member 11 while at least one lock hole 11*c* is formed in a cover side surface 11*b* thereof. Meanwhile, an inner surface of the cover member 11 functions as a guide when the pivot member 12 is turned or as a guide when the lock member 13 slides in the axial direction.

The pivot member 12 projects from the hole 11*a* in the cover member 11. The pivot member 12 is provided with: the shaft portion 9 having the square cross section to be fitted into the fitting hole 3*c* in the hinge projecting portion 3*b*; a cylindrical portion 12*a* having substantially the same diameter as that of the hole 11*a* of the cover member 11; and an engagement recessed portion 12*b* to be engaged with the lock member 13. Here, the engagement recessed portion 12*b* is formed from inclined surfaces that define such a tapered shape that a deeper point becomes narrower. The shaft portion 9 is in contact with a hole bottom of the engagement hole 3*c*.

A cross section of the lock member 13 is formed into a quadrangular shape which is substantially the same as the cross-sectional shape of the inside of the cover member 11. A tapered engagement projecting portion 13*a* is formed on an end surface of the lock member 13 opposed to the pivot member 12; a base portion of the tapered engagement projecting portion 13*a* is wider in width; inclined surfaces of the tapered engagement projecting portion 13*a* become narrower toward a tip end; and inclination angles of the tapered engagement projecting portion 13*a* correspond to inclination angles of the engagement recessed portion 12*b* of the pivot member 12. The lock member 13 is biased toward the pivot member 12 in the axial direction by an action of the compression coil spring 14. Accordingly, the lock member 13 is non-turnably put into the cover member 11 and is made slidable in the axial direction.

For this reason, when the engagement projecting portion 13*a* of the lock member 13 is engaged with the engagement recessed portion 12*b* of the pivot member 12, it is possible to stop turning of the pivot member 12. Meanwhile, when the pivot member 12 is turned by applying a force thereto, the engagement projecting portion 13*a* moves along the inclined surfaces of the engagement recessed portion 12*b* and then in a direction to run over the inclined surfaces. Thus, the lock member 13 moves in a direction away from the pivot member 12 against the biasing force of the compression coil spring 14, whereby the compression coil spring 14 is compressed and the engagement projecting portion 13*a* is disengaged from the engagement recessed portion 12*b*.

The engagement recessed portion 12*b* and the engagement projecting portion 13*a* only need to be formed into such shapes that establish the engagement with each other. Accordingly, the engagement recessed portion 12*b* may be formed into a projecting portion while the engagement projecting portion 13*a* may be formed into a recessed portion instead. In the meantime, the inclination angles of each of the engagement recessed portion 12*b* and the engagement projecting portion 13*a* is not particularly limited. However, it is preferable to define such inclination angles that enables component forces of the biasing force of the compression coil spring 14 caused by the inclined surfaces to act in a direction to close the container main body 2 with the lid body 3 when the container main body 2 is closed with the lid body 3. Here, the lock member 13 and the pivot member 12 provided in such a way as to establish engagement or disengagement by the turning action correspond to first compressing and releasing means.

In order to support the compression coil spring 14, a hole 15*a* having a similar shape to a contour of the compression coil spring 14 is formed in the cover bottom member 15. Meanwhile, a lock projection 15*b* to be locked to the lock hole 11*c* in the cover member 11 is formed in a side surface of the cover bottom member 15. Accordingly, the first pivot support member 6 establishes an integrated unitized state by putting the cover member 11 over the cover bottom member 15 and locking the lock projection 15*b* of the cover bottom member 15 to the lock hole 11*c* in the cover member 11.

Figure 5:
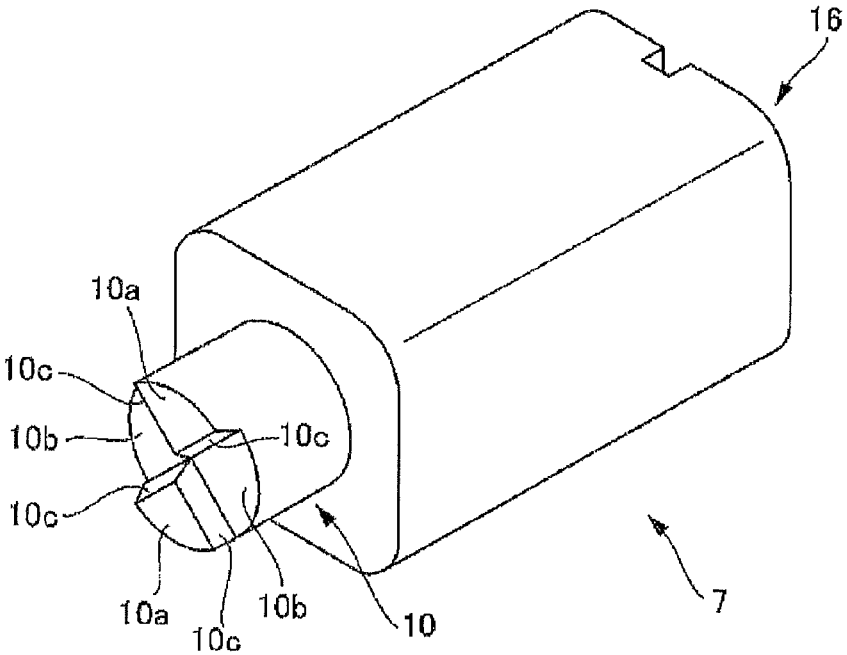
FIG. 5 is a perspective view showing the second pivot support mechanism to be applied to the cosmetic container of FIG. 1.

FIG. 5 is a perspective view showing the second pivot support mechanism 7 to be fitted into the container main body 2 side. The second pivot support mechanism 7 includes a main body portion 16 to be fitted into the support member fitting portion 2*g* of the container main body 2, and the shaft portion 10 projecting from the main body portion 16. The main body portion 16 has an external shape formed substantially into a rectangular parallelepiped, and is fitted into the support member fitting portion 2*g* and made non-turnable relative to the container main body 2.

The shaft portion 10 is designed to coincide with an axis of the pivot member 12 of the first pivot support member 6 fitted into the support member fitting portion 2*f* on the left when the main body portion 16 is fitted into the support member fitting portion 2*g* on the right. In other words, the shaft portion 9 of the first pivot support member 6 and the shaft portion 10 of the second pivot support mechanism 7 form a pivot shaft of the lid body 3.

A cross section of the shaft portion 10 is formed into a circular shape having an outside diameter slightly smaller than an inside diameter of the insertion hole 3*d* provided in the hinge projecting portion 3*b* of the lid body 3. A tip end surface of the shaft portion 10, i.e., a surface to be inserted into the insertion hole 3*d* and opposed to the bottom surface of the insertion hole 3*d* is provided with fan-shaped projecting portions 10*a* and fan-shaped recessed portions 10*b* to be engaged with the fan-shaped projecting portions 3*e* and the fan-shaped recessed portions 3*g* of the insertion hole 3*d*, thereby being formed into the same shape as the bottom surface of the insertion hole 3*d*.

Specifically, regarding the fan-shaped projecting portions 10*a* and the fan-shaped recessed portions 10*b* of the shaft portion 10, a circular area forming the contours of the shaft portion 10 and the insertion hole 3*d* are divided into four fan-shaped regions, and two regions not adjacent to each other are formed into the projecting portions 10*a* each having the fan shape while spaces between the projecting portions 10*a* are formed into the recessed portions 10*b* each having the fan shape.

Each of the fan-shaped projecting portions 10*a* provided in the two regions is formed such that a vertex of its center angle is directed to an outer periphery toward the tip end while maintaining the center angle of 90 degrees, and that its cross-sectional area becomes gradually reduced toward the tip end of the shaft portion 10 and an entrance of the insertion hole 3*d*. In other words, a region corresponding to each of two sides of the fan forms an inclined surface 10*c*. Meanwhile, since the fan-shaped projecting portions 3*e* and the fan-shaped recessed portions 3*g* have the same shape, each of the fan-shaped projecting portions 3*e* and the fan-shaped recessed portions 3*g* has an inclined surface 3*h*.

The fan-shaped projecting portions 10*a* and the fan-shaped recessed portions 10*b* only need to be formed into such shapes that establish the engagement with one another. Accordingly, the inclination angle of each of the fan-shaped projecting portions 10*a* and the fan-shaped recessed portions 10*b* is not particularly limited. However, it is preferable to define such an inclination angle that enables component forces of the resilience of the compression coil spring 14 caused by the inclined surfaces 3*h* and 10*c* to act in a direction to close the container main body 2 with the lid body 3 when the container main body 2 is closed with the lid body 3. For example, it is preferable that the inclination angle of each of the inclined surfaces 3*h* and 10*c* relative to the axial direction of the shaft portion 10 be set to about 15 degrees.

The tip end surface of the shaft portion 10 and the bottom surface of the insertion hole 3*d* have the same shape. Accordingly, when the shaft portion 10 is inserted into the insertion hole 3*d* and the tip end surface of the shaft portion 10 is opposed to the bottom surface of the insertion hole 3*d*, the fan-shaped projecting portions 10*a* at the tip end of the shaft portion 10 are engaged with the fan-shaped recessed portions 3*g* of the bottom surface of the insertion hole 3*d*, and the fan-shaped recessed portions 10*b* at the tip end of the shaft portion 10 are engaged with the fan-shaped projecting portions 3*e* of the bottom surface of the insertion hole 3*d*. Thus, the turning of the lid body 3 is restricted.

When the lid body 3 is turned to be opened, the inclined surfaces 10*c* of the fan-shaped recessed portions 10*b* on the shaft portion 10 side slide over the inclined surfaces 3*h* of the fan-shaped projecting portions 3*e* of the insertion hole 3*d*, and a force acts on the hinge projecting portion 3*b* in a direction away from each other. At this time, the hinge projecting portion 3*b* is pressed toward the first pivot support member 6, and this pressure compresses the compression coil spring 14 of the first pivot support member 6. Hence, the resilience of the compression coil spring 14 brings about a frictional force between the inclined surfaces 3*h* of the fan-shaped projecting portions 3*e* of the insertion hole 3*d* and the inclined surfaces 10*c* of the fan-shaped recessed portions 10*b* on the shaft portion 10 side which slide over each other. The resilience and the frictional force serve as a load when the lid body 3 is turned.

Thereafter, an amount of compression of the compression coil spring 14 reaches a maximum when the fan-shaped projecting portions 3*e* of the insertion hole 3*d* are disengaged from the fan-shaped recessed portions 10*b* on the shaft portion 10 side and the fan-shaped projecting portions 10*a* on the shaft portion 10 side and the fan-shaped projecting portions 3*e* of the insertion hole 3*d* start facing one another. When the lid body 3 is turned further, the lid body 3 is turned while changing the area of opposition between the fan-shaped surface of each fan-shaped projecting portion 3*e* of the insertion hole 3*d* and the fan-shaped surface of the corresponding fan-shaped recessed portion 10*b* on the shaft portion 10 side. Then, the fan-shaped projecting portions 3*e* of the insertion hole 3*d* are engaged with the fan-shaped recessed portions 10*b* on the shaft portion 10 side.

As for the second pivot support mechanism 7, every time the lid body 3 is turned 90 degrees, the fan-shaped surfaces of the fan-shaped projecting portions 10*a* on the shaft portion 10 side are opposed to the fan-shaped surfaces of the fan-shaped recessed portions 3*g* of the insertion hole 3*d*, whereby the compression to the compression coil spring 14 is released. Here, the hinge projecting portion 3*b* and the second pivot support mechanism 7 provided in such a way as to establish engagement or disengagement by the turning action correspond to second compressing and releasing means. Meanwhile, the hinge projecting portion 3*b* and the shaft portion 10 of the second pivot support mechanism 7, which include the fan-shaped projecting portions 3*e* and 10*a* and the fan-shaped recessed portions 3*g* and 10*b*, correspond to projecting members including projecting portions projecting in the pivot axis direction and recessed members including recessed portions into which the projecting portions can be inserted, respectively.

The compact container 1 of the embodiment realizes a so-called free-stop function to maintain an opened state of the lid body 3 by using the first pivot support member 6 provided on the left side of the hinge recessed portion 2*e* and the second pivot support mechanism 7 provided on the right side thereof.

Figure 6:
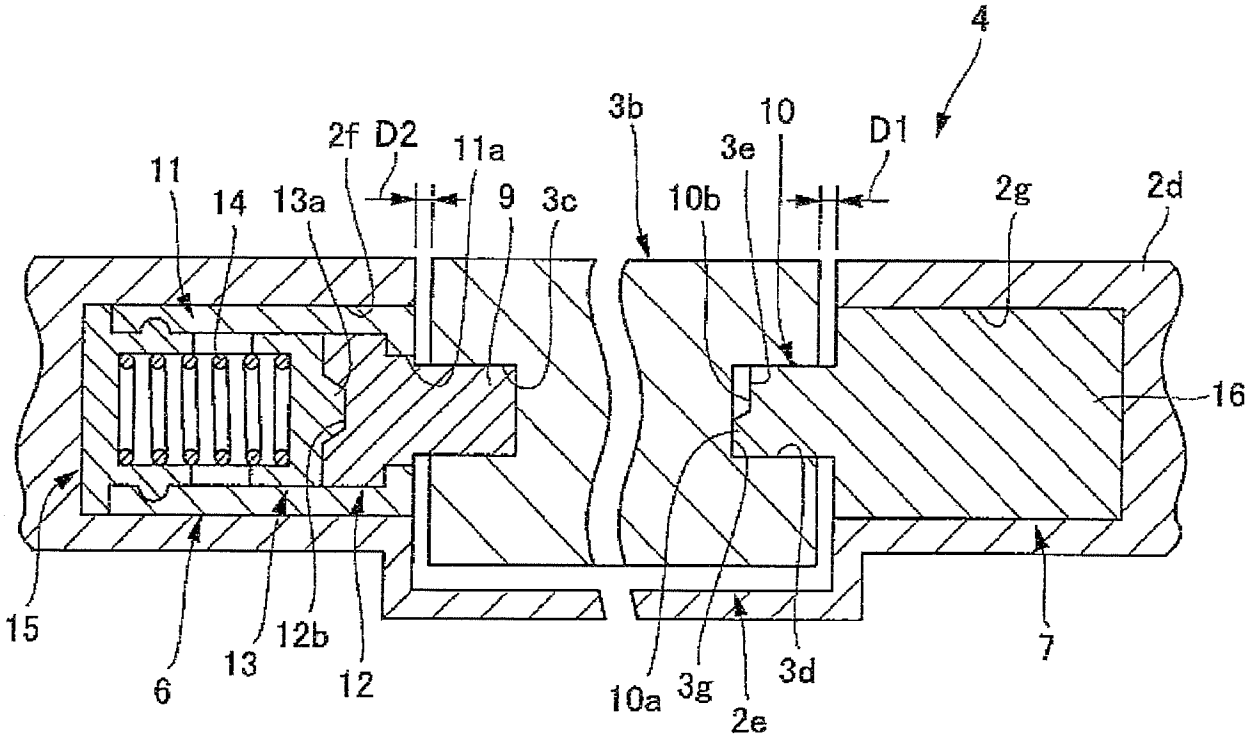
FIG. 6 is a cross-sectional view showing an aspect of the second pivot support mechanism when the lid body is closed.
Figure 7:
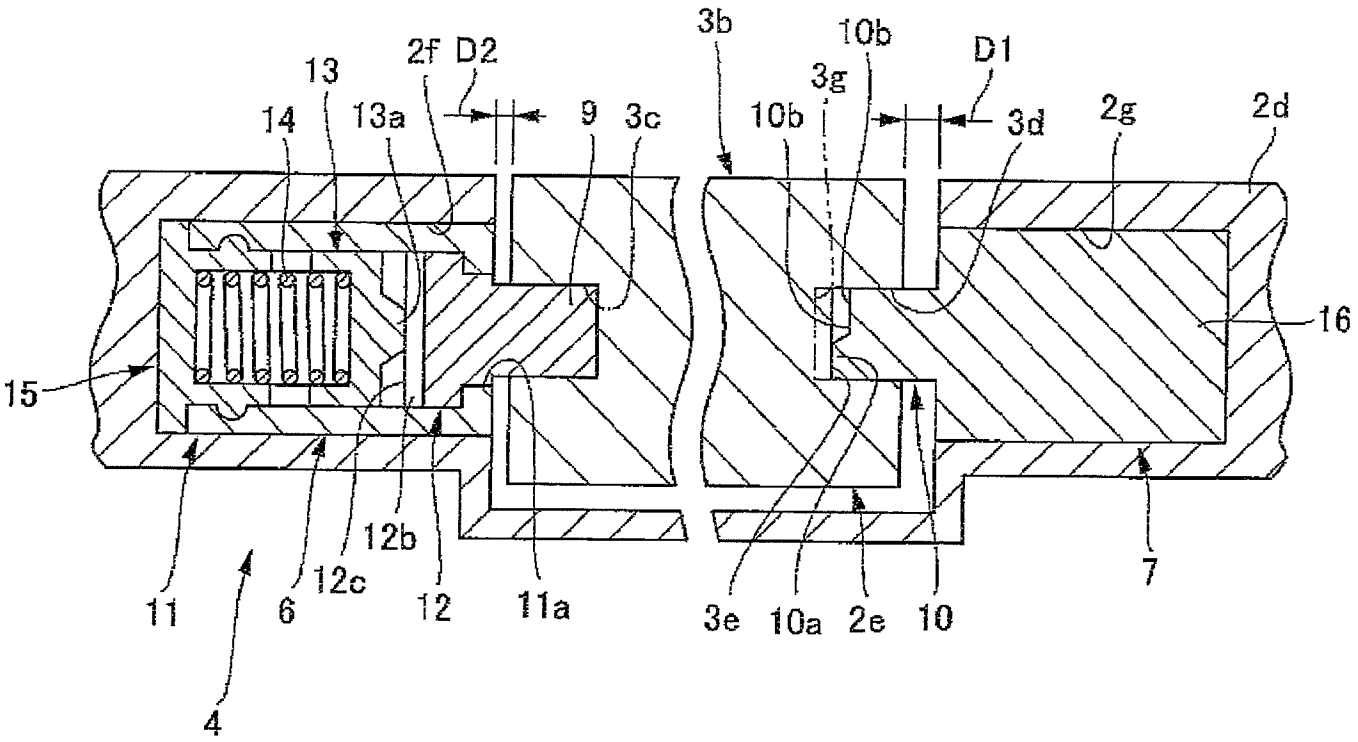
FIG. 7 is a cross-sectional view showing an aspect of the second pivot support mechanism when the lid body is maintained in its opened state.

FIG. 6 is a cross-sectional view showing the second pivot support mechanism 7 in the state where the lid body 3 is closed. FIG. 7 is a cross-sectional view showing the second pivot support mechanism 7 in the state where the lid body 3 is maintained in the opened state. Specifically, in the state of the compact container 1 where the lid body 3 is closed, for example, the engagement projecting portion 13*a* of the lock member 13 of the first pivot support member 6 is engaged with the engagement recessed portion 12*b* of the pivot member 12 while the fan-shaped projecting portions 10*a* of the shaft portion 10 included in the second pivot support mechanism 7 are engaged with the fan-shaped recessed portions 3*g* of the insertion hole 3*d* as shown in FIG. 6. In this case, a first clearance D1 is formed between the second pivot support mechanism 7 and the hinge projecting portion 3*b*, and a second clearance D2 is formed between the first pivot support member 6 and the hinge projecting portion 3*b*.

When the lid body 3 is turned, the engagement projecting portion 13*a* of the first pivot support member 6 moves along the inclined surfaces of the engagement recessed portion 12*b* and runs onto the end surface 12*c* of the cylindrical portion 12*a*, while the fan-shaped projecting portions 3*e* of the insertion hole 3*d* move along the inclined surfaces 10*c* of the fan-shaped recessed portions 10*b* of the shaft portion 10. At this time, the lock member 13 and the pivot member 12 move in the direction away from each other, and the hinge projecting portion 3*b* moves in a direction away from the second pivot support mechanism 7. In other words, the hinge projecting portion 3*b* moves inside the hinge recessed portion 2*e* in such a manner that the first clearance D1 is expanded and the second clearance D2 is narrowed at the same time. Accordingly, the compression coil spring 14 of the first pivot support member 6 is compressed not only by the first pivot support member 6 but also by the second pivot support mechanism 7 at the same time. In this case, the shaft portion 9 is in contact with the hole bottom of the fitting hole 3*c* so that the movement of the hinge projecting portion 3*b*, or more specifically, the action of the second pivot support mechanism 7 can be reliably transmitted to the compression coil spring 14 without wasting such an action. If necessary, a setting may be configured in which a compressive force acts on the compression coil spring 14 in the state where the lid body 3 is closed as shown in FIG. 6.

As the compression coil spring 14 is compressed, the resilience of the compression coil spring 14 acts on the opposed inclined surfaces of the engagement projecting portion 13*a* and the engagement recessed portion 12*b* as well as the opposed inclined surfaces 3*h* and 10*c* of the fan-shaped projecting portions 3*e* of the insertion hole 3*d* and the fan-shaped recessed portions 10*b* of the shaft portion 10. At the same time, the frictional force is generated as well.

Then, as the lid body 3 is turned further, the engagement projecting portion 13*a* of the lock member 13 is disengaged from the engagement recessed portion 12*b* of the pivot member 12, and the fan-shaped projecting portions 3*e* of the insertion hole 3*d* are disengaged from the fan-shaped recessed portions 10*b* of the shaft portion 10 included in the second pivot support mechanism 7 as shown in FIG. 7. At this time, the lock member 13 and the pivot member 12 are most distant while the hinge projecting portion 3*b* and the second pivot support mechanism 7 are most distant. As a consequence, the compression coil spring 14 is compressed to a maximum while the frictional force attributed to the resilience of the compressed compression coil spring 14 grows larger. Thus, the lid body 3 can be maintained in the opened state.

In the meantime, when the lid body 3 is opened, the compression coil spring 14 has to be compressed to the extent that makes the lock member 13 and the pivot member 12 move away from each other in such a manner as to disengage the engagement projecting portion 13*a* of the lock member 13 from the engagement recessed portion 12*b* of the pivot member 12, and makes the insertion hole 3*d* and the second pivot support mechanism 7 move away from each other in such a manner as to disengage the fan-shaped projecting portions 3*e* of the insertion hole 3*d* from the fan-shaped recessed portions 10*b* of the shaft portion 10 included in the second pivot support mechanism 7. In other words, a sufficient force for compressing the compression coil spring 14 is required in order to open the lid body 3. Thus, it is possible to maintain the lid body 3 in the closed state as well.

Thereafter, when the lid body 3 is turned about 90 degrees, the fan-shaped projecting portions 10*a* of the shaft portion 10 in the second pivot support mechanism 7 are engaged with the fan-shaped recessed portions 3*g* of the insertion hole 3*d*. At this time, the hinge projecting portion 3*b* and the second pivot support mechanism 7 having been located away from each other come closer to each other. Accordingly, the amount of compression of the compression coil spring 14 is reduced and the frictional force is reduced at the same time. As for the first pivot support member 6, since the state where the lock member 13 is away from the pivot member 12 is maintained, the frictional force on the first pivot support member 6 side remains active.

When the lid body 3 is turned further, the fan-shaped projecting portions 3*e* of the insertion hole 3*d* move along the inclined surfaces 10*c* of the fan-shaped recessed portions 10*b* of the shaft portion 10 included in the second pivot support mechanism 7, and then the fan-shaped projecting portions 3*e* of the insertion hole 3*d* are disengaged from the fan-shaped recessed portions 10*b* of the shaft portion 10 included in the second pivot support mechanism 7. At this time, the hinge projecting portion 3*b* and the second pivot support mechanism 7 are located away from each other again. Thus, the compression coil spring 14 is further compressed whereby the resilience and the frictional force of the compressed compression coil spring 14 are increased.

Thereafter, when the lid body 3 is further turned about 90 degrees, the engagement projecting portion 13*a* of the lock member 13 of the first pivot support member 6 is engaged with the engagement recessed portion 12*b* of the pivot member 12 to engage the fan-shaped projecting portions 3*e* of the shaft portion 10 included in the second pivot support mechanism 7 with the fan-shaped recessed portions 3*g* of the insertion hole 3*d*. At this time, the lock member 13 and the pivot member 12 having been located away from each other come closer to each other. Accordingly, the amount of compression of the compression coil spring 14 is reduced.

The state where the lid body 3 is opened about 180 degrees is equivalent to the state where the engagement projecting portion 13*a* of the lock member 13 of the first pivot support member 6 is engaged with the engagement recessed portion 12*b* of the pivot member 12. Meanwhile, the state where the fan-shaped projecting portions 10*a* of the shaft portion 10 included in the second pivot support mechanism 7 are engaged with the fan-shaped recessed portions 3*g* of the insertion hole 3*d* is equivalent to the state where the lid body 3 is closed. Accordingly, the sufficient force for compressing the compression coil spring 14 is also required to close the lid body 3 from the state opened about 180 degrees.

According to the compact container 1 of the embodiment, the lid body 3 is turnably supported by the container main body 2 through the first pivot support member 6 and the second pivot support mechanism 7. Moreover, when the lid body 3 is turned, the compression coil spring 14 included in the first pivot support member 6 is compressed and the compression coil spring 14 thus compressed generates the resilience. Hence, a load attributed to the resilience can maintain the lid body 3 in the opened state.

Meanwhile, the second pivot support mechanism 7 also compresses the compression coil spring 14 included in the first pivot support member 6 when the lid body 3 is turned, and the resilience is thus generated. Accordingly, the second pivot support mechanism 7 can increase the load attributed to the resilience without being provided per se with the compression coil spring 14 or a mechanism for holding the compression coil spring 14 in an expandable and contractible manner, and maintain the lid body 3 in the opened state more stably and at low costs.

In other words, it is possible to stabilize the action of the hinge portion that includes the single first pivot support member 6 provided with the compression coil spring 14, and to improve opening and closing functions of the lid body 3 inclusive of the free-stop function.

The embodiment has described the example in which the container main body 2 includes the first pivot support member 6 and the second pivot support mechanism 7, which are fitted thereinto. Instead, the first pivot support member 6 and the second pivot support mechanism 7 may be provided integrally with the container main body 2. When the first pivot support member 6 and the second pivot support mechanism 7 are integrally provided to the container main body 2, such a structure is simple and easy to assemble.

On the other hand, when the first pivot support member 6 and the second pivot support mechanism 7 are provided separately from the container main body 2, the first pivot support member 6 and the second pivot support mechanism 7 can be formed from a material different from that of the container main body 2. For this reason, the material used for an exterior portion, whose external appearance should be emphasized, may be different from the material used for a functional portion which is apt to be worn out by the sliding. Thus, it is possible to achieve high design quality and excellent opening and closing performances.

Meanwhile, the embodiment has described the example in which the lid body 3 is integrally provided with the fitting hole 3*c* into which the pivot member 12 of the first pivot support member 6 is fitted, and the insertion hole 3*d* into which the shaft portion 10 of the second pivot support mechanism 7 is inserted. Instead, the fitting hole 3*c* and the insertion hole 3*d* may be provided in separate members and such members may be fixed to the lid body 3. In this case, as well, the freedom of material selection is increased by providing the fitting hole 3*c* and the insertion hole 3*d* to the separate members. Thus, it is possible to form the hinge having higher performances.

Meanwhile, the embodiment has described the example in which the lid body 3 is provided with the fitting hole 3*c* and the insertion hole 3*d* while the container main body 2 is provided with the first pivot support member 6 and the second pivot support mechanism 7. Instead, the lid body 3 may be provided with the first pivot support member 6 and the second pivot support mechanism 7 while the container main body 2 may be provided with the fitting hole 3*c* and the insertion hole 3*d*. In the embodiment, each of the fan-shaped projecting portions 10*a* and 3*h* and the fan-shaped recessed portions 10*b* and 3*g* of the second pivot support mechanism 7 and the insertion hole 3*d* is formed into the fan shape with the center angle of 90 degrees. However, the center angle is not limited to the foregoing.

Meanwhile, the embodiment has stated that the engagement projecting portion 13*a* of the lock member 13 of the first pivot support member 6 is engaged with the engagement recessed portion 12*b* of the pivot member 12, and the fan-shaped projecting portions 10*a* of the shaft portion 10 included in the second pivot support mechanism 7 are engaged with the fan-shaped recessed portions 3*g* of the insertion hole 3*d* in the closed state of the lid body 3. However, the present invention is not limited only to the foregoing. For instance, only one of the two combinations described above may be engaged or none of the combinations may be engaged in the closed state of the lid body 3.

Meanwhile, the embodiment has explained the example in which the hinge projecting portion 3*b* is provided to the lid body 3 and the hinge recessed portion 2*e* for containing the hinge projecting portion 3*b* is provided to the container main body 2. Instead, the hinge projecting portion may be provided to the container main body while the hinge recessed portion may be provided to the lid body. Alternatively, of two positions in the horizontal direction of the container main body, the lid body may be provided with the hinge projecting portion to be contained in the hinge recessed portion in the container main body at one position while the container main body may be provided with the hinge projecting portion to be contained in the hinge recessed portion in the lid body at the other position. Likewise, the configuration of the hinge portion may be changed in various ways.

REFERENCE SIGNS LIST

1 compact container
2 container main body
3 lid body
3*b* hinge projecting portion
3*e* fan-shaped projecting portion of hinge
3*g* fan-shaped recessed portion of hinge
6 first pivot support member
7 second pivot support mechanism
10 shaft portion of second pivot support mechanism
10*a* fan-shaped projecting portion of shaft portion
10*b* fan-shaped recessed portion of shaft portion
12 pivot member
13 lock member
14 compression coil spring

The invention claimed is:

1. A cosmetic container comprising:

a container main body configured to contain a cosmetic and having a first and second hinge sections provided along an edge of the container main body;

a lid body connected to the container main body and having first and second hinge sections provided along an edge of the lid body and aligned with the two hinge sections of the container main body to allow the lid body to open and close the container main body; and a pivot support means disposed in the first hinge sections of the container body and the lid body, a pivot support mechanism disposed in the second hinge sections of the container body and the lid body, the pivot support means including a compression coil spring located between the first hinge sections of the container body and the lid body and configured to generate resilience when compressed along a pivot axis of the hinge sections, and means for compressing the compression coil spring and releasing the compression of the compression coil spring in turn along the pivot axis by turning operation of the lid body, and the pivot support mechanism includes a shaft portion stationary provided on one of the second hinge sections of the container main body and the lid body and recessed portions provided in the other of the second hinge sections of the container main body and the lid body, said shaft portion being slidably engaged with and disengaged from the recessed portions in turn when the lid body is turned about the axis of the hinge sections, whereby when the lid body is turned about the container main body from the position that the shaft portion in the second hinge section is engaged with the recessed section toward the position to be disengaged with the recessed section, the lid body is shifted relative to the container main body along the axis of the hinge sections and the compression coil spring in the first hinge section is compressed further to generate a reaction force to hold the lid body in position to the container main body.

2. A cosmetic container according to claim 1, wherein the means for compressing the compression coil spring and releasing the compression of the compression coil spring in the pivot support means comprises, other than the compression spring, a pivot member and a lock member; the pivot member is rotatably provided in the first hinge section of the container body and having a shaft portion engaged with a fitting hole provided in the first hinge section of the lid body; the lock member is slidably provided in the first hinge section in the container body adjacent to the pivot member and urged to the pivot member by the compression spring and slidably engaged with a recessed portion of the pivot member; and wherein the shaft portion of the pivot support mechanism is stationary provided in the second hinge section of the container body; the recessed portions and projection portions are provided on a bottom of an insertion hole in the second hinge section of the lid body; and the recessed portions and projection portions are formed successively in turn in the circumferential direction of the insertion hole.

3. A cosmetic container according to claim 2, wherein each of the recessed portions and the projecting portions is fan-shaped and the shaft portion of the pivot support mechanism has also fan-shaped recessed portions and projecting portions at a tip end thereof.

* * * * *